US005878583A

United States Patent [19]

Schlosser et al.

[11] Patent Number: 5,878,583

[45] Date of Patent: Mar. 9, 1999

[54] ICE MAKING MACHINE AND CONTROL METHOD THEREFORE

[75] Inventors: Charles E. Schlosser; Cary J. Pierskalla; Gregory F. Krcma, all of Manitowoc, Wis.

[73] Assignee: Manitowoc Foodservice Group, Inc., Sparks, Nev.

[21] Appl. No.: 828,761

[22] Filed: Apr. 1, 1997

[51] Int. Cl.[6] ..... F25C 1/12

[52] U.S. Cl. ..... 62/73; 62/135; 62/156

[58] Field of Search ..... 62/156, 73, 135, 62/352, 303

[56] References Cited

U.S. PATENT DOCUMENTS

| | | | |
|---|---|---|---|
| 4,412,429 | 11/1983 | Kohl | 62/347 |
| 4,442,681 | 4/1984 | Fischer | 62/347 |
| 4,947,653 | 8/1990 | Day et al. | 62/156 |
| 4,995,245 | 2/1991 | Chang | 62/515 |
| 5,031,417 | 7/1991 | Chang | 62/347 |
| 5,065,584 | 11/1991 | Byczynski et al. | 62/84 |
| 5,182,925 | 2/1993 | Alvarez et al. | 62/347 |
| 5,193,357 | 3/1993 | Kohl et al. | 62/347 |
| 5,237,837 | 8/1993 | Naruse et al. | 62/434 |
| 5,257,506 | 11/1993 | DeWolf et al. | 62/156 |
| 5,289,691 | 3/1994 | Schlosser et al. | 62/303 |
| 5,291,752 | 3/1994 | Alvarez et al. | 62/344 |
| 5,345,782 | 9/1994 | Takahashi et al. | 62/344 |
| 5,419,151 | 5/1995 | Minari et al. | 62/347 |

OTHER PUBLICATIONS

Advertisement by U–Line Corporation entitled, "The U–Line BI–15 Ice Maker," May 1995, 1 page.

*Primary Examiner*—William E. Tapolcal
*Attorney, Agent, or Firm*—Steven P. Shurtz; Brinks Hofer Gilson & Lione

[57] ABSTRACT

An ice making machine comprises a refrigerant system having a compressor, a condenser, an expansion device, an evaporator and interconnecting refrigerant lines; a water system having a fresh water inlet, a water circulation mechanism, an ice-forming device in thermal contact with the evaporator and interconnecting water lines; and a control system comprising a temperature sensing device in thermal contact with the outlet of the condenser, and a microprocessor programmed to use input from the temperature sensing device either i) at a predetermined time after initiation of a freeze cycle to determine the desired duration of the freeze cycle or ii) at a predetermined time prior to the end of the freeze cycle to determine the desired duration of the harvest cycle, or iii) both i) and ii), to control the refrigeration and water systems to operate in a freeze cycle and/or the harvest cycle until the end of the desired duration(s).

28 Claims, 10 Drawing Sheets

ICE MAKING MACHINE AND CONTROL METHOD THEREFORE

BACKGROUND OF THE INVENTION

The present invention relates to ice making machines and particularly to control methods for automatic ice making machines.

Numerous automatic ice making machines have been developed over the years. Most of these machines have been free-standing units that are connected to electrical and water supplies and make ice using a standard refrigeration system. The ice machines often have a control system which automatically operates the machine through freeze and harvest cycles, and which turns the machine off when sufficient supplies of ice have been made.

Such ice machines come in all sizes, from large machines that make hundred of pounds of ice in an hour, to smaller machines which make a few pounds of ice an hour, the control systems for such machines vary from sophisticated to simple.

Many cube ice making machines use a hot gas bypass valve to harvest the cube ice by sending hot refrigerant from a compressor directly to an evaporator mounted on the back of a cube forming evaporator plate. Instead of freezing water into ice, the evaporator then melts the ice. Knowing when to start and end the harvest cycle is important. The maximum efficiency of the machine requires that the harvest cycle be started when ice has formed sufficiently, and stopping the harvest cycle as soon as the ice is released from the ice forming evaporator plate. Prior art patents disclose the use of ice thickness sensors to initiate a harvest cycle, and an electro-mechanical sensor, such as a water curtain switch, to detect when the ice cubes fall off of the ice-forming evaporator plate. There are numerous other control sensors and mechanisms to start and stop the harvest cycle.

One problem with many of the sophisticated control systems is that they require components that add significant cost to the ice making machine. On relatively small ice machines, where the manufacturing cost is minimized, a trade off is made in that the control system does not operate the machine in the most efficient manner. For example, in some ice machines, the durations of the freeze and harvest cycles are based on a sensor which measures the temperature or pressure of the refrigerant on the suction side of the compressor. Other systems use a thermostat on the evaporator or outlet of the evaporator. In these systems, when a predetermined temperature is reached, the machine changes to a harvest cycle, and when another temperature is reached, they change back to a freeze cycle. When the ambient air is warmer, the freeze cycle duration is longer. Some such systems include an adjustment knob so that the cycle time can be increased or decreased as desired if ice cube thickness is too great or too small.

One problem with such a simple control system is that it does not automatically take into account several variables. For example, the optimum freeze and harvest cycle durations will depend not only on ambient air temperatures, but on such factors as how clean the condenser is, and whether any foreign objects are blocking the flow of air past the condenser. The adjustment knob can be used to adjust the cycle times as these factors change, but this often requires a service technician, or is not done properly. As a result, the machines may not produce sufficient ice, and they have higher operating costs than necessary.

U.S. Pat. Nos. 5,182,925 and 5,291,752 to Alverez et al. disclose an ice machine that starts the harvest cycle when enough of a batch of water initially charged to a reservoir has frozen into ice to trip a low water sensor. A thermistor located at the outlet of the condenser is used to end the harvest cycle. The temperature of refrigerant is measured by the thermistor at the beginning of the harvest cycle to get an idea of how hot the refrigerant is that is passing through the hot gas defrost valve. A microcontroller then determines what the temperature of the refrigerant out of the evaporator should be when the harvest cycle is complete. A second thermistor on the outlet side of the evaporator is monitored and when this temperature is reached, the system ends the harvest cycle and returns to the freeze cycle. Alternatively, the microcontroller sets a time for the harvest to last. In yet another alternative, the microcontroller looks at the rate at which the refrigerant exiting the evaporator rises, and when a substantial rise is detected, terminates the harvest cycle.

This control mechanism has several drawbacks. First, it requires a variety of sensors, including a low water level sensor and two thermistors. Second, the thermistor located on the exit side of the evaporator is located where it has to be protected from water condensation on the cold refrigerant return line and is subject to vibrations from the compressor, which is also connected to this line. Third, the time period at which the thermistor senses the temperature of the refrigerant leaving the condenser is right after the harvest cycle commences, which is a relatively unstable time period during the refrigeration cycle which makes consistency of operation more difficult.

It would be of great benefit if a simple control mechanism could be developed which could initiate a harvest cycle without the use of a water level sensor or ice thickness sensor, both of which are subject to failure after repeated use in conditions to which they are typically exposed. Also, it would be beneficial if an inexpensive control system could be developed that could be used on small ice machines that would not add much to their manufacturing cost but which could greatly improve the efficiency of the machine compared to simple control systems known heretofore. Preferably such an improved control system would start and stop the harvest cycle dependent on varying conditions, including not only ambient temperature, but increasing amounts of dirt on condenser coils and partial blockage of air flow past the condenser coil.

SUMMARY OF THE INVENTION

It has been discovered that there is a strong correlation between the optimum freeze cycle duration and the temperature of the refrigerant exiting the condenser at a predetermined period of time after the beginning of the freeze cycle when the refrigerant is in a stable part of the cycle and ice has started to freeze. Also, it has been discovered that there is a strong correlation between the optimum harvest cycle duration and the temperature of the refrigerant exiting the condensor at a predetermined period of time prior to the end of the freeze cycle. Using these discoveries, and related discoveries by the present inventors, a simple control system for an ice machine has been developed which preferably uses only one sensor, a thermistor located on the outlet side of the condenser.

In a first aspect, the invention is a method of initiating a harvest cycle in an ice making machine having a compressor, a condenser, an expansion device, an evaporator and refrigerant lines therebetween, the method comprising the steps of: a) initiating a freeze cycle during which refrigerant from the compressor flows to the condenser, through the expansion device and to the evaporator; b)

measuring the temperature of the refrigerant at a point between the condenser and the expansion device at a predetermined time period after initiation of the freeze cycle; c) using the measured temperature to determine the desired duration of the freeze cycle; and d) ending the freeze cycle and initiating the harvest cycle at the end of the desired duration of the freeze cycle.

In a second aspect, the invention is a method of controlling the harvest cycle duration of an ice making machine comprising the steps of: a) initiating a freeze cycle during which refrigerant is compressed by a compressor and discharged to a condenser, from which the refrigerant flows in a refrigerant line to an expansion device, through an evaporator and back to the compressor; b) measuring the temperature of the refrigerant leaving the condenser at a predetermined time before termination of the freeze cycle; c) using the temperature measured in step b) to determine the desired duration of the harvest cycle; and d) ending the harvest cycle after the length of time determined in step c). Preferably the first and second aspects of the invention are used together.

In a third aspect, the invention is an ice making machine comprising: a) a refrigeration system comprising a compressor, a condenser having an inlet and an outlet, an expansion device, an evaporator and interconnecting refrigerant lines; b) a water system comprising a fresh water inlet, a water circulation mechanism, an ice-forming device in thermal contact with the evaporator, and interconnecting water lines; and c) a control system comprising a temperature sensing device in thermal contact with the outlet of the condenser, and a microprocessor programmed to use input from the temperature sensing device at a predetermined time after initiation of a freeze cycle to determine a desired duration of the freeze cycle, or at a predetermined time prior to the end of the freeze cycle to determine a desired duration of the harvest cycle, or both, and control the refrigeration and water systems to operate the freeze cycle and/or harvest cycle until the end of the desired duration, and thereafter switch cycles.

By using a thermistor to measure the temperature of the refrigerant leaving the condenser at a predetermined time after the freeze cycle starts, or at a predetermined time prior to the termination of the freeze cycle, variables such as condenser cleanliness and air flow blockage, ambient air temperature, and compressor fluctuations can be accurately accounted for. In addition, the thermistor is placed in an environment that is typically warm and dry. Also, the preferred embodiment of the control system uses this one thermistor to determine the optimum durations of both the freeze and harvest cycles. Thus the major control functions of the ice making machine can be controlled using only one sensor.

These and other advantages of the invention will be best understood in view of the attached drawings, a brief description of which follows.

DETAILED DESCRIPTION OF THE DRAWINGS AND PREFERRED EMBODIMENTS OF THE INVENTION

A preferred embodiment of an ice making machine 10 incorporating the present invention is shown in FIGS. 1–4. The machine is housed within a cabinet 14 that has insulated walls on its upper portion and a base containing some of the mechanical components. A door 12 (shown in FIG. 1 but removed from the other figures for sake of clarity) fits over the front opening of the cabinet 14. The front of the base section of the machine is covered by a grill 16 that allows air to pass through the base compartment. The door 12 preferable is connected to the top of the cabinet 14 on pivots that allow it to swing up and slide up into the top of the machine 10 when someone wishes to remove ice from the machine 10.

Figure 4:
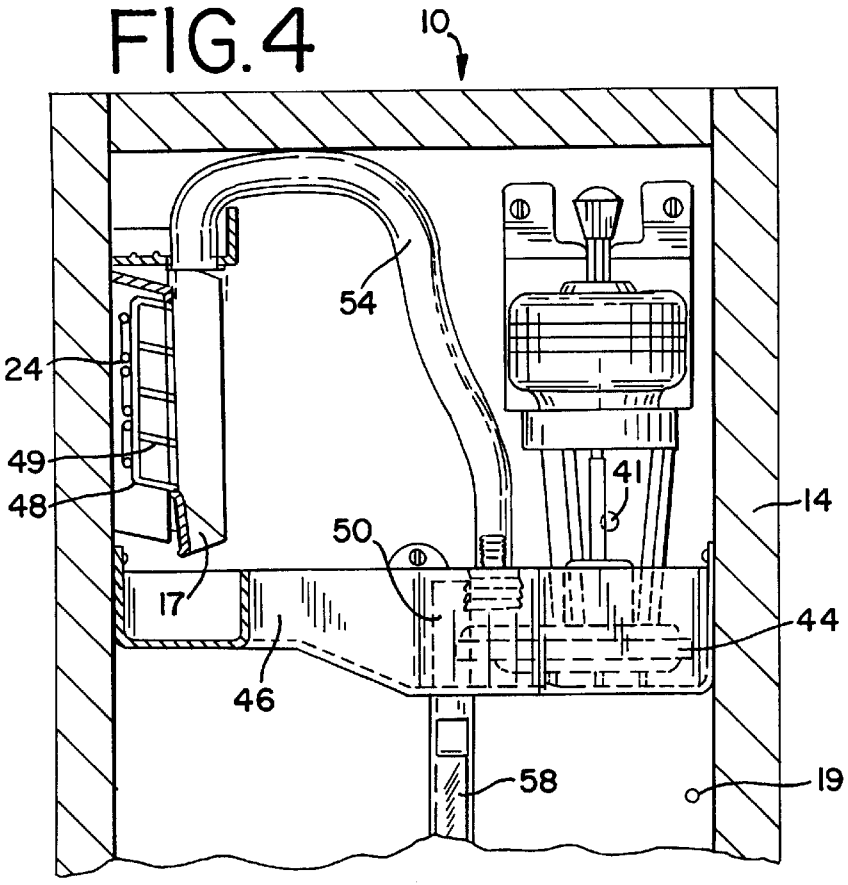
FIG. 4 is a cross sectional view taken along line 4—4 of FIG. 3.
Figure 5:
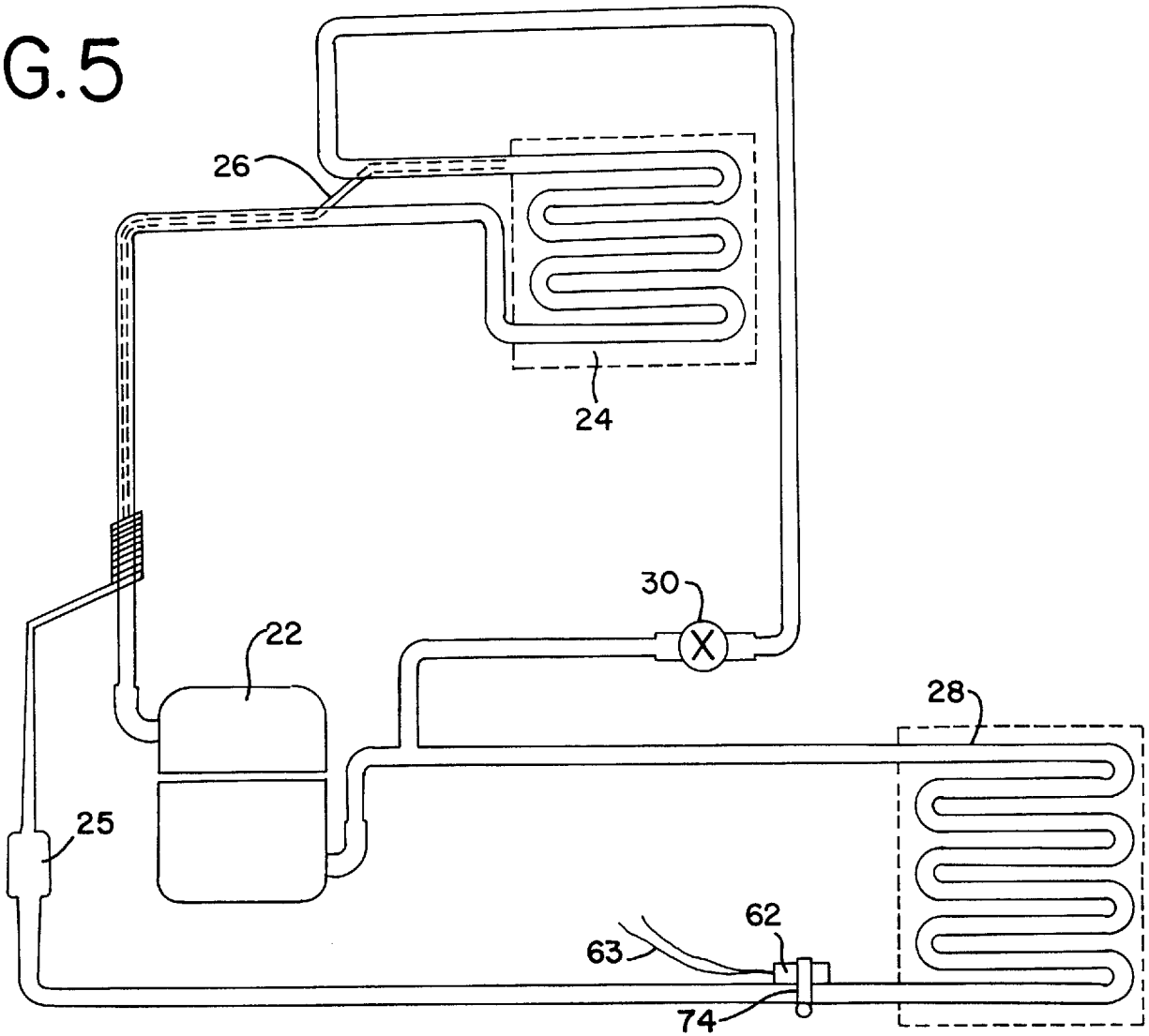
FIG. 5 is a schematic view of the refrigerator system of the ice machine of FIG. 1.

Inside the ice making machine 10 there is an ice storage bin 36 that sits above the base compartment of the machine. The machine includes a water system, a refrigeration system and a control system, each explained in detail below. The water system includes a water circulation mechanism, preferably in the form of a pump 44 of conventional design. The base of the pump sits in a water reservoir 46 attached to the inside of the cabinet 14 above the ice bin 36. Water enters the water reservoir 46 through a fresh water inlet 41, preferably controlled by a water inlet solenoid valve 42 (FIG. 5). Excess water is allowed to overflow a stand tube 50 and flow out of a drain line 58, best seen in FIG. 4. Water from the pump 44 travels though water line 54 to a distributor 52 from which it flows around baffles molded into the distributor 52 (best seen in FIG. 3) and down over an ice-forming device 48, described in more detail below. Water that does not freeze flows back into the reservoir 46. During cleaning operations, the reservoir may preferably be drained by pulling out the stand tube 50.

Figure 2:
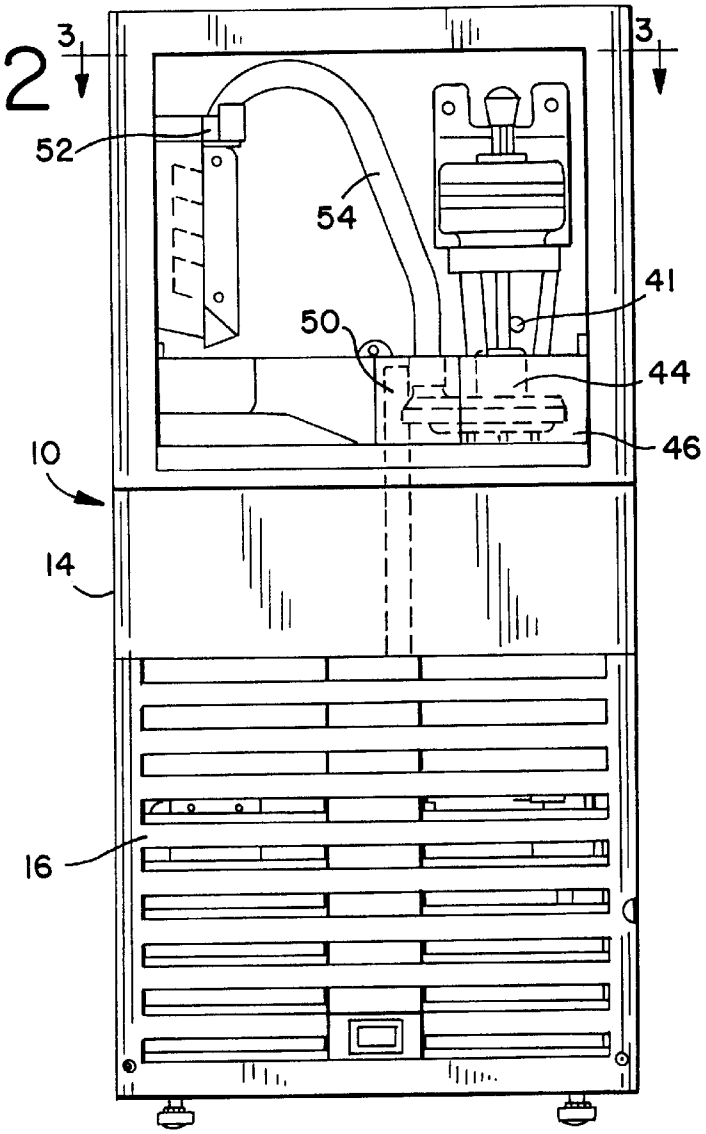
FIG. 2 is a front view of the ice machine of FIG. 1.
Figure 1:
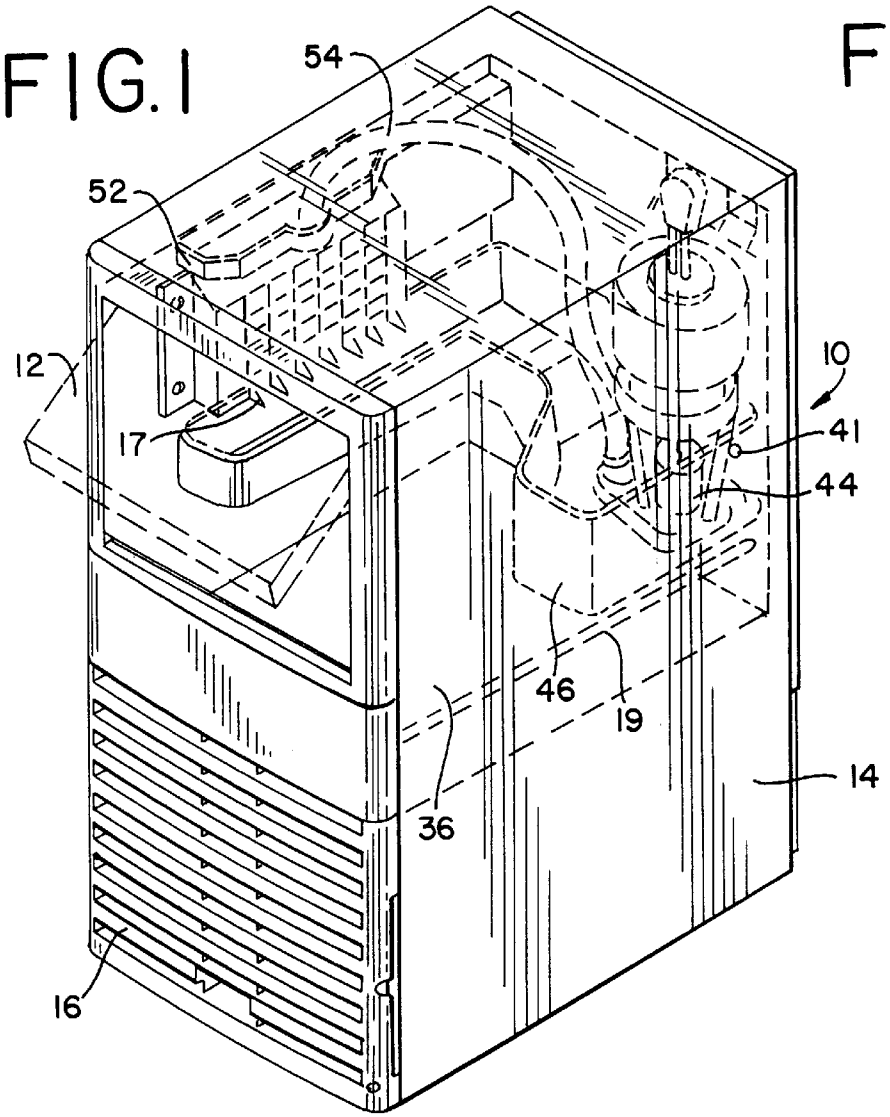
FIG. 1 is a perspective view of a new, small ice machine of the preferred embodiment of the invention.

The ice-forming device 48 is preferably constructed of a unique stamped metal pan. In the past, such pans were made by folding sheet metal to form sides surrounding the base of the pan. The edges where these sides contacted one another would have to be sealed to prevent water from escaping out of the pan. The pan of the present invention is preferably drawn or stamped out of copper, and the side walls are thus formed as a monolithic unit with the base plate. The corners where the side walls meet are water impervious without further treatment. The ice forming device 48 further includes a grid 49 (FIG. 4) that cooperates with the side walls of the pan to form individual pockets in which ice cubes are formed. The horizontal members of the grid 49 and the top and bottom sidewalls of the pan are sloped downwardly at an angle of about 15 degrees so that the ice cubes will slide out easily once the harvest cycle starts to defrost the evaporator coils 24 on the back of the pan. The ice-forming device 48 is preferably made by insert injection molding the stamped metal pan so that plastic components are molded onto the pan. As best seen in FIG. 1, these plastic components include tabs for attaching the ice-forming device 48 to the cabinet 14, as well as fins 17 to deflect ice cubes falling out of the device so that they do not fall into the water reservoir 46 but rather fall into the ice bin 36. Preferably the stamped pan includes a lip around its outside edge which cooperates with the mold tool to shut off the flow of plastic during the molding process.

The refrigeration system, shown schematically in FIG. 5, includes a compressor 22, a condenser 28, an evaporator 24 and an expansion device in the form of a capillary tube 26. The compressor 22 and condenser 28 are housed in the base of the ice machine 10. The evaporator is in the form of serpentine tubing or coils mounted on the back of the ice-forming device 48 (FIG. 4). Normally refrigerant flows from the compressor 22 to the condenser 28, through the capillary tube 26 and to the evaporator 24. However, during the harvest cycle, a hot gas bypass valve 30 opens and allows hot refrigerant to flow directly to the evaporator 24 from the compressor 22. The refrigeration system preferably also includes a dryer 25 just upstream from the capillary tube 26. The capillary tube 26 is routed to the inlet side of the evaporator 24. The capillary tube 26 has a very small diameter and functions as a restriction, providing a measured amount of resistance to the flow of refrigerant therethrough. The refrigerant is in a liquid form as it enters the capillary tube 26, and is then allowed to expand in the evaporator into a gas. The restricted flow capillary tube 26 thus serves as an expansion device. The capillary tube 26 is wrapped around the refrigerant line connected to the suction side of the compressor 22 and then penetrates through an outside wall of this refrigerant line and travels down the interior of the refrigerant line, as shown by the dotted lines in FIG. 5. The capillary tube 26 exits the suction side refrigerant line and enters the refrigerant line on the inlet side of the evaporator 24. The contact between the capillary tube and the suction side refrigerant line establishes good thermal contact between the lines, providing heat transfer for the refrigerants inside, as explained in U.S. Pat. No. 5,065,584, which is hereby incorporated by reference. For the most part, the details of the refrigeration system are not critical to the invention, but rather are within the ordinary skill in the art, and are therefore not described in further detail. It is noted however, that as with other small ice machines, having the correct amount of refrigerant in the referigeration system is highly important to the proper functioning of the machine.

The control system for the ice making machine 10 includes very few components. As described above, a temperature sensing device, preferably an aluminum encapsulated thermistor 62, is located on the outlet side of the condenser 28. The preferred thermistor 62 is part No. E1004AB22P1 from Advanced Thermal Products, Saint Marys; Pa.

Preferably the thermistor 62 is in good thermal contact on a straight piece of the refrigerant line, and may be held in place by a tube clamp 74 (FIG. 5). The thermistor is a thermal variable resistor, the resistance of which changes proportionally to its temperature. A pair of wires 63 connect the thermistor 62 with a circuit board mounted in the machine 10. A current of known voltage is supplied to the thermistor 62. As the temperature of the refrigerant exiting the condenser 28 changes, the refrigerant tubing and aluminum encapsulation quickly transfer heat by conduction and cause the temperature, and hence the resistance, of the thermistor 62, to also change. As a result, the voltage drop across the thermistor 62 constitutes an electrical output proportional to the temperature of the refrigerant line. This electrical output, i.e. voltage drop, is then used as an input within the rest of the control system.

Figure 6:
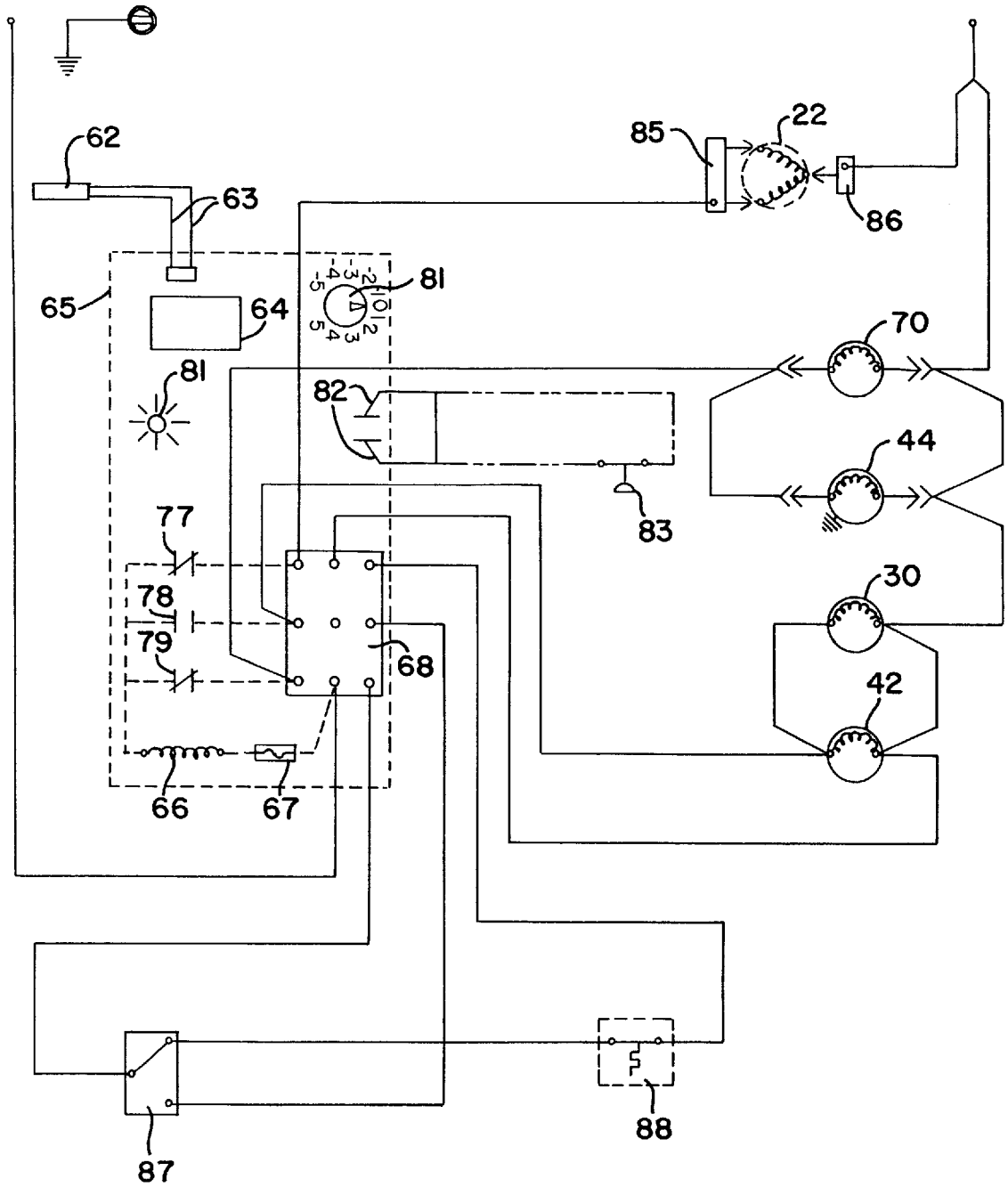
FIG. 6 is a schematic diagram of the electrical system used in the ice machine of FIG. 1.
Figure 7:
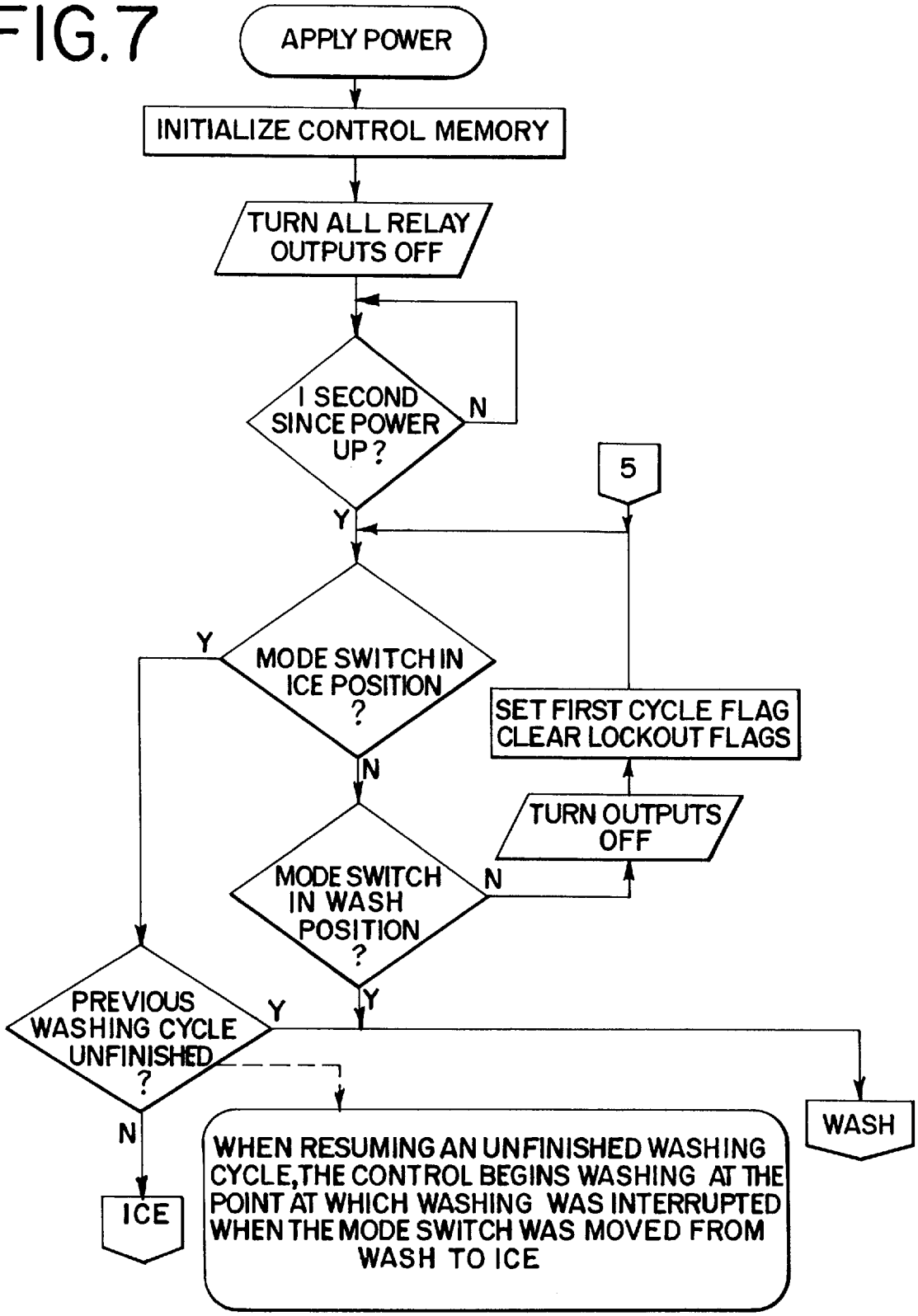
FIGS. 7–12 are flow charts of the computer program used in the microprocessor of the controller of the ice machine of FIG. 1.
Figure 8:
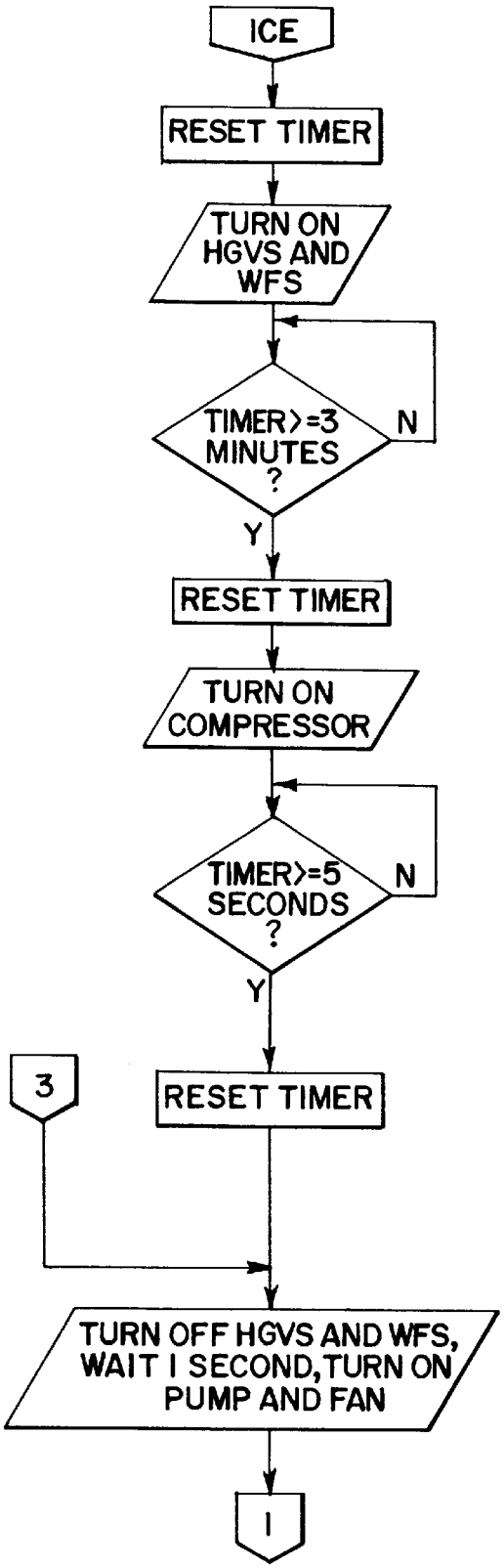
Figure 9:
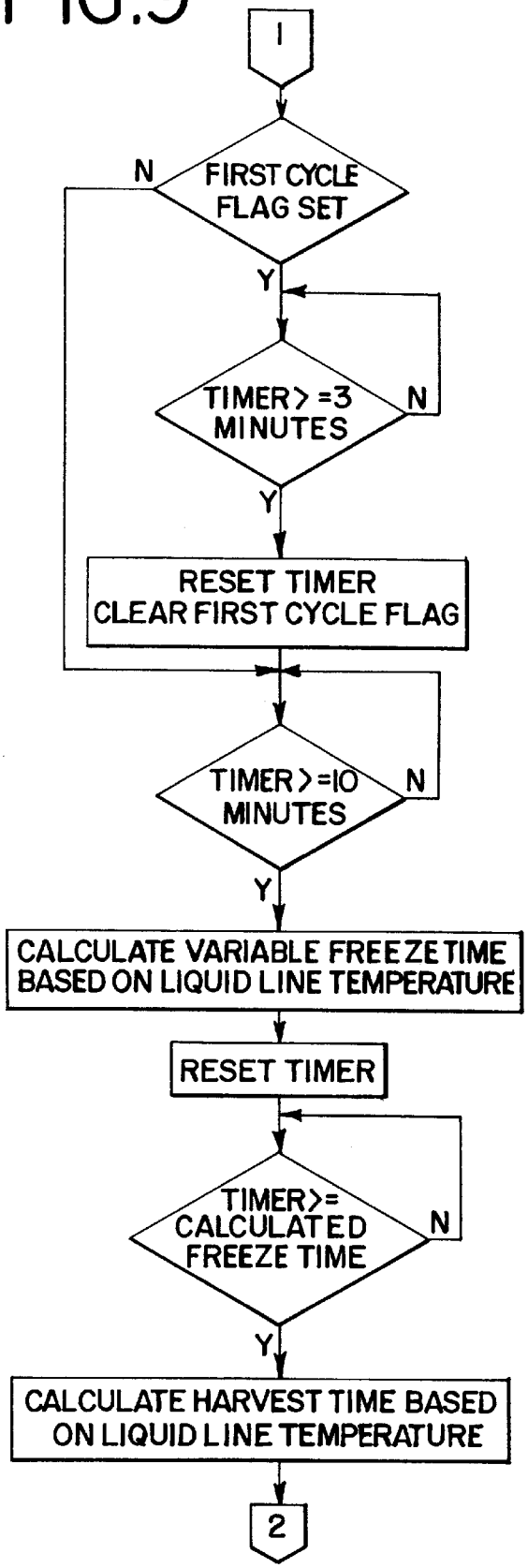
Figure 10:
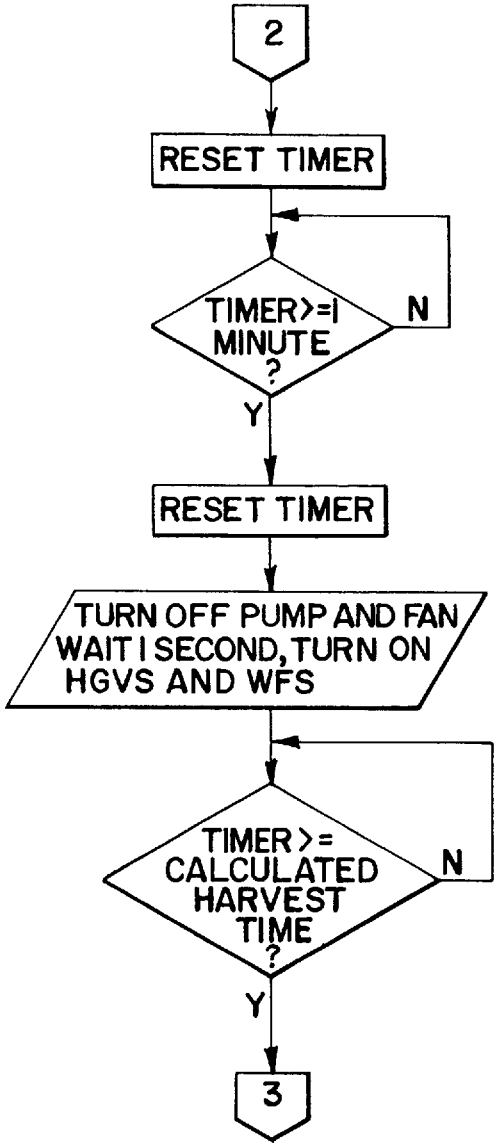

The preferred control system of the present invention includes a microprocessor 64 mounted on a circuit board 65, depicted in FIG. 6. Also mounted on control board 65 is a transformer 66, a fuse 67, a socket and plug 68 by which numerous wires can attach to the circuit board 65, three relays 77, 78 and 79, a LED light 80 and an ice-thickness adjustment knob 81, which is used to manually increase the freeze cycle times. A pair of jumper wires 82 may optionally be used to connect a high pressure cutout switch 83 to the circuit board 65. The high pressure cutout is a well known safety device required when water cooled condensers are used. If the machine 10 is located where waste water from the machine cannot drain by gravity to a sewer line, a drain pump (not shown) may be used. Such drain pumps often include a safety back up switch that can be wired to the main device to shut off the main device if the drain pump fails. The jumper wires 82 may optionally be used to connect the safety back up switch of such a drain pump so that the ice machine 10 can be shut down if such a drain pump fails. If both a drain pump and a high pressure cutout are used, the drain pump safety back up switch and the high pressure cutout switch can be wired in series using jumper wires 82 so that either switch may be used to shut down the machine.

Figure 3:
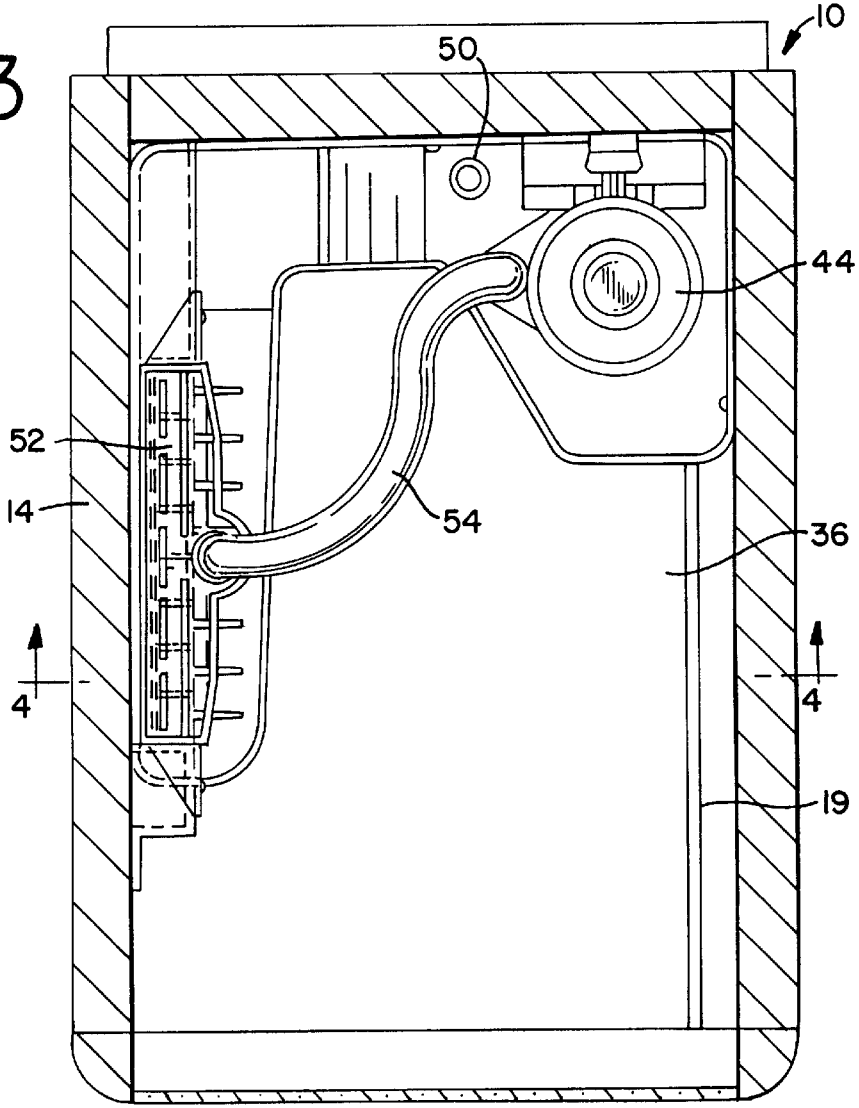
FIG. 3 is a cross sectional view takes along line 3—3 of FIG. 2.

FIG. 6 shows the electrical wiring for the other components of the machine, such as a fan 70 that draws air passed the condenser, the water pump 44, the hot gas solenoid valve 30 and the water inlet solenoid 42. The electrical schematic of FIG. 6 shows the components as they are electrically operated when the machine 10 is making ice. The compressor 22 preferably has a built in overload protector 85 as well as a starting device 86. The machine 10 preferably includes a toggle switch 87 with three positions. In FIG. 6 the toggle switch is shown in its normal "on" or "ice" making position. When no contact is made (when the switch is in its center position), the machine is off. When the bottom connection is made, the machine 10 is switched into a "wash" mode, described below. The control system preferably also includes a bin thermostat 88 to detect when the ice bin 36 has sufficient ice in it that the refrigeration system can be shut down. The bin thermostat uses a pliable capillary tube, as is well known in the art. To protect the capillary tube, a nickel plated copper tube 19, best seen in FIGS. 1,3 and 4, is secured in the ice bin 36 and acts as a well to house the bin thermostate capillary tube. The bin thermostat 88 preferably includes a knob and dial to allow adjustments to the thermostat based on altitude, as is conventional in the art.

One unique feature of the preferred embodiment of the invention, and which cuts down on its cost, is that some of the relays are used to control more than one device. The fan motor 70 and water pump 44 are thus controlled by one relay, relay 79, and are on simultaneously. Likewise the hot gas bypass valve 30 and water inlet valve 42 are both opened by energizing the relay 78. The result is that when a harvest cycle begins, fresh water is also added to the water reservoir 46. As the water reservoir will be refilled before the harvest cycle finishes, the continued addition of water causes water in the reservoir 46 to overflow the tube 50, rinsing away impurities that would otherwise build up as pure water freezes into ice. When the harvest cycle begins, the fan 70 and water pump 44 shut down until the next freeze cycle begins.

The microprocessor 64 includes a computer program that uses various inputs to control the ice making components of the machine 10. The flowcharts for the various routines in the computer program are detailed in FIGS. 7–12. The microprocessor 64 is programmed to use input from the temperature sensing device, such as the thermistor 62, (referred to as "LIQUID LINE TEMPERATURE" in the flowcharts) at a predetermined time after initiation of a freeze cycle to determine the desired duration of the freeze cycle and control the refrigeration system and the water system to operate in a freeze cycle until the end of the desired duration and then operate in a harvest cycle. Alternatively, or, more preferably, in addition, the microprocessor 64 is programmed to use input from thermistor 62 at a predetermined time prior to the end of the freeze cycle to determine the desired duration of the harvest cycle. When the duration of the freeze cycle is determined by the microprocessor 64, it will be simple for the microprocessor to also take a temperature measurement at a predetermined period of time before the end of the freeze cycle. If the freeze cycle is ended by some less preferred mechanism, the microprocessor could maintain a floating memory of temperature, and use the temperature in such memory one minute earlier when a freeze cycle is terminated.

Figure 13:
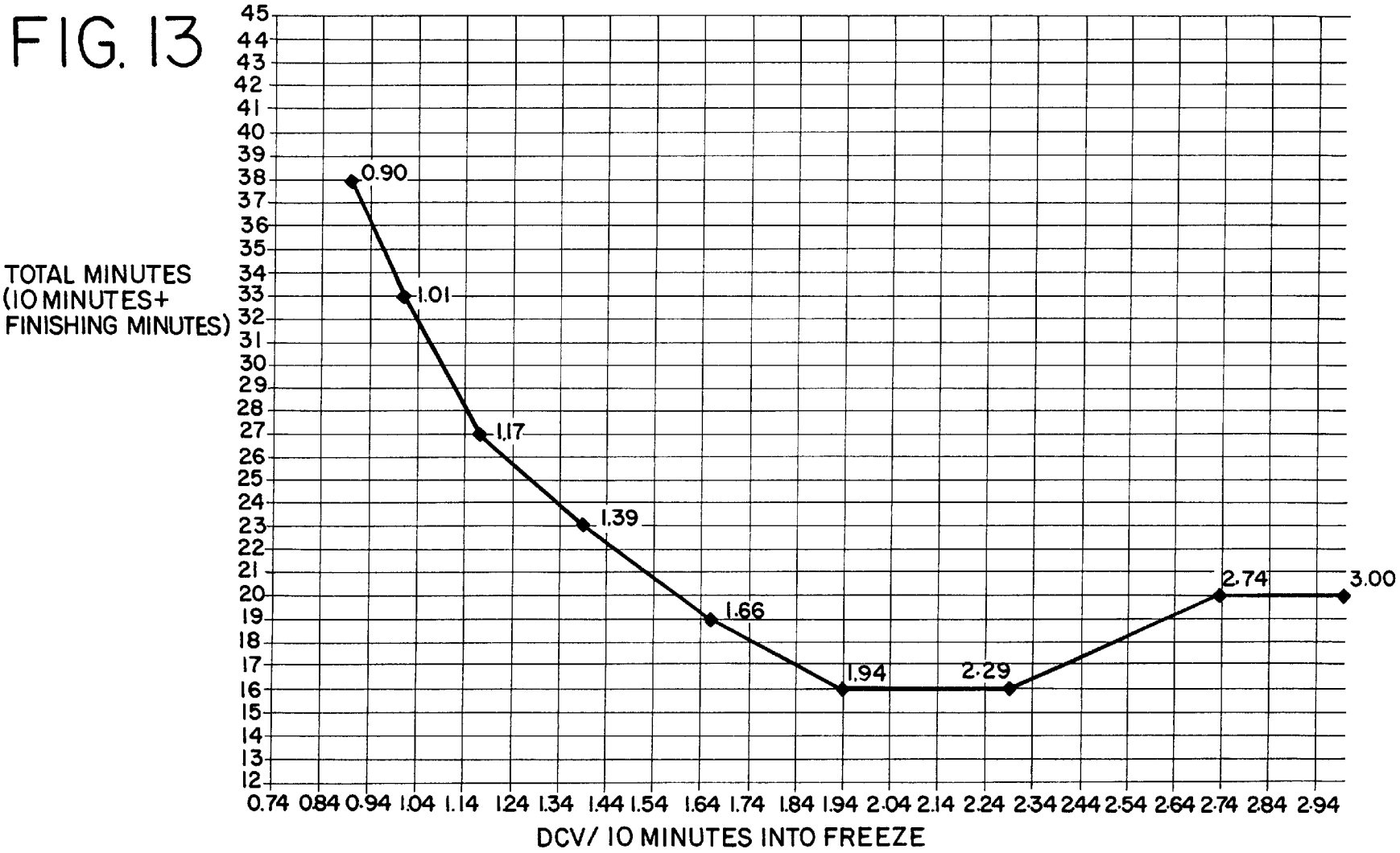
FIG. 13 is a graph of the relationship between optimum total freeze cycle duration and the voltage from the thermistor, which is proportional to the temperature of the refrigerant exiting the condenser, measured ten minutes after the freeze cycle begins, for the ice machine of FIG. 1.
Figure 14:
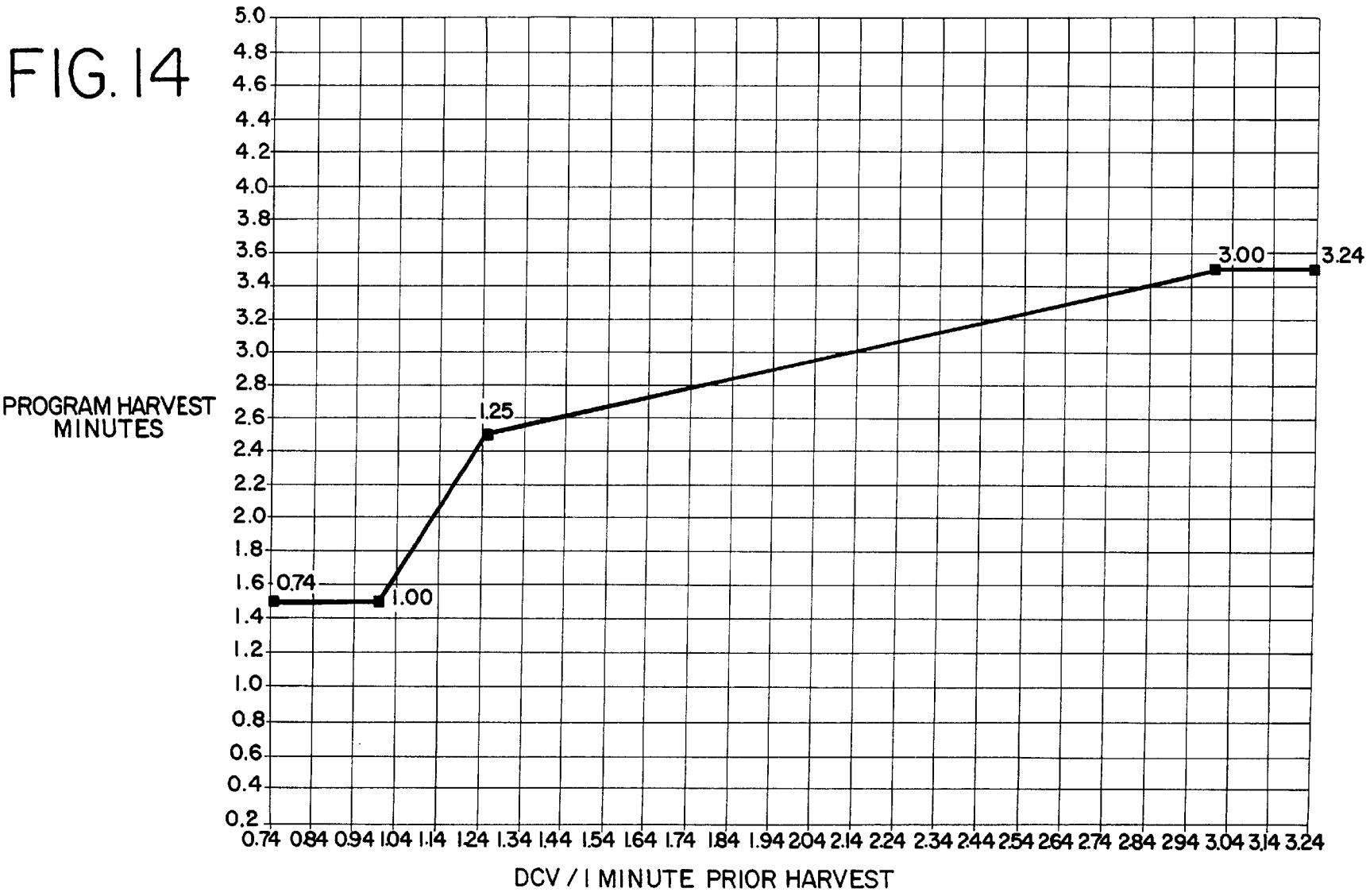
FIG. 14 is a graph of the relationship between the optimum total harvest cycle duration and the voltage from the thermistor, which is proportional to the temperature of the refrigerant exiting the condenser, measured one minute before the end of the freeze cycle, for the ice machine of FIG. 1.

The temperature, or more preferably the thermistor readings used by the microprocessor, are preferably an average value of several readings within a short period of time, such as sixteen readings taken one second apart. The microprocessor 64 preferably includes recorded data of optimum freeze and harvest cycle durations compared to thermistor readings, which are representative of temperature measurements. The data for the preferred ice machine 10 is shown in FIGS. 13 and 14. The data may be in the form of mathematical formulas modeling the curves shown in FIGS. 13 and 14. Preferably, however, the data will be in the form of a look-up tables which are used to determine these desired durations, based on a voltage coming back from the thermistor 62.

The ice making machine 10 has a normal operating mode and a "wash" operating mode. In the normal operating mode, the toggle switch 87 (referred to as "MODE SWITCH" in the flowcharts) is in the "on" (or "ice") position and the ice machine will normally be making ice unless the bin thermostat 88 indicates that the ice bin 36 is already full. On the initial startup of the machine, or restart of the machine after the bin thermostat indicates additional ice is needed (FIG. 8), the first thing that happens is that the hot gas bypass and water inlet solenoids 30, 42 (referred to as "HGVS" and "WFS" respectively in the flowcharts) are energized. This allows the water reservoir 46 to fill up. The compressor 22 is energized after the hot gas and water inlet solenoids are energized for 3 minutes. The compressor runs for five seconds with the hot gas bypass valve open, which makes it easier to start the compressor. After this five seconds, the water pump 44 and condenser fan motor 70 are energized, and the hot gas and water inlet solenoids 30, 42 are deenergized. The machine is now in a freeze cycle (FIG. 9) with the compressor, water pump, and condenser fan motor energized, and the hot gas and water inlet solenoids deenergized. Ten minutes into the freeze cycle, the microprocessor 64 reads the voltage returning from the thermistor and determines how long to remain in the freeze cycle. One minute prior to finishing this freeze time, a second resistance reading of the thermistor 62 is made to determine the length of the harvest cycle. When the freeze cycle is completed (FIG. 10), the control system deenergizes the water pump 44 and the condenser fan motor 70 and energizes the hot gas and water inlet solenoids 30, 42 for the harvest cycle duration. The compressor 22 remains energized during the harvest cycle. At the conclusion of the harvest cycle, the machine returns to a new freeze cycle (FIG. 8), with the compressor 22, water pump 44, and condenser fan motor 70 all energized. The hot gas and water inlet solenoids 30, 42 are deenergized.

The ice thickness adjustment knob 81 located on the circuit board 65 may be used to add or subtract up to five minutes from the desired freeze time determined from the look-up table. On the initial startup cycle, when the freeze cycle starts and the compressor has not been running, the run time for the freeze cycle will be three minutes longer than the normal time determined from the look-up table (see FIG. 9). This is accomplished by running the compressor for 3 minutes before starting the 10 minute time. As a result, in this first cycle, the thermistor voltage is actually measured after 13 minutes of running time. This incremental increase in the initial freeze cycle compensates for inefficiencies associated with the initial startup cycle. All subsequent freeze cycle durations follow the programmed time based on the look-up table. The machine will continue to cycle through freeze and harvest cycles until the bin thermostat 88 opens, breaking power to the control board. When the bin thermostat recloses, the machine restarts as outlined above.

Figure 11:
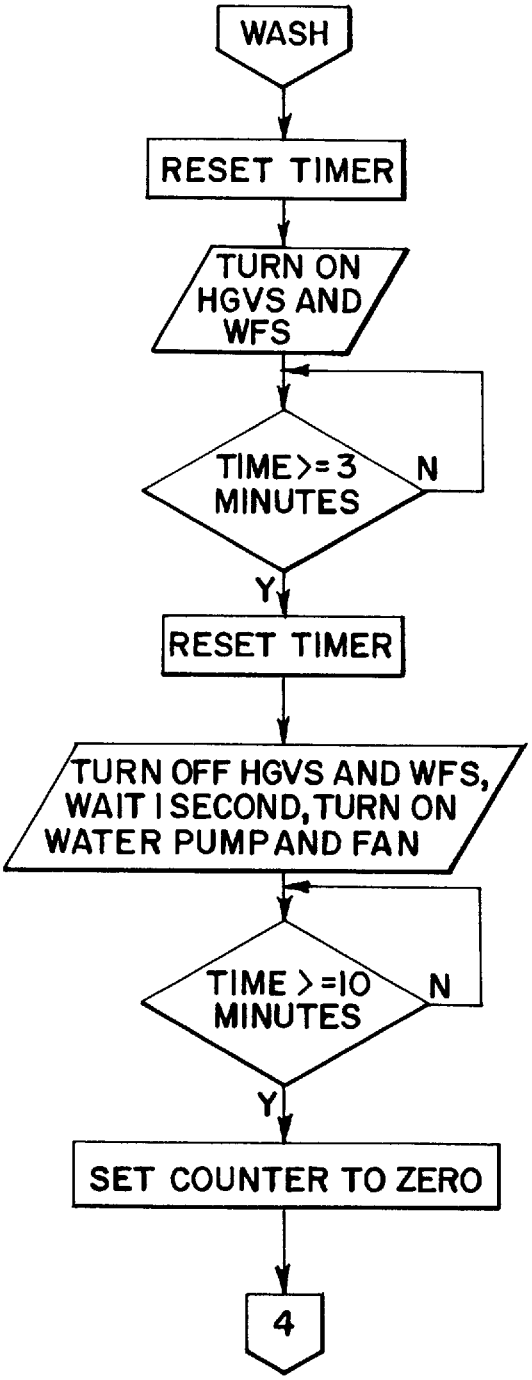
Figure 12:
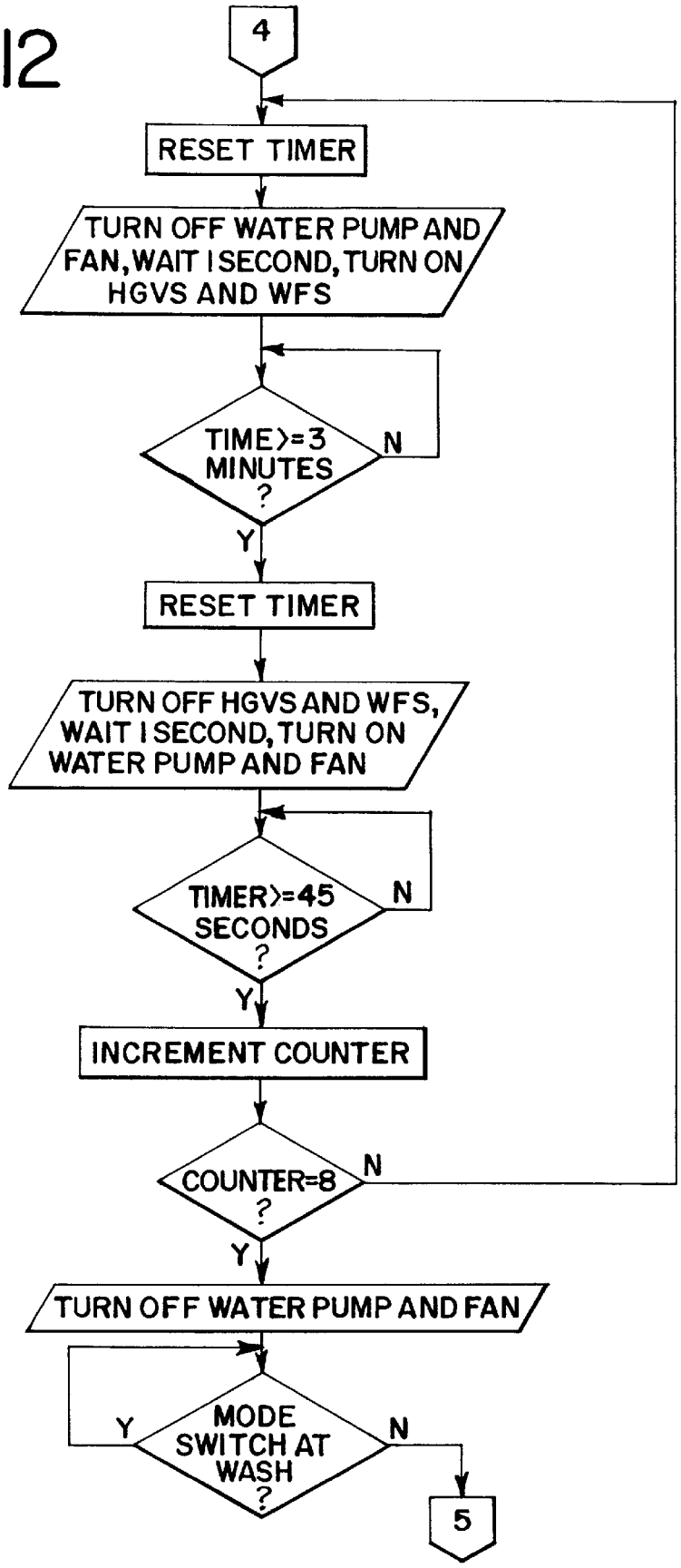

When the toggle switch is set in the "wash" position, the microprocessor 64 cycles the system through wash, fill, and rinse cycles depicted in FIGS. 11 and 12. These cycles and the components that are energized are as follows. During the first fill cycle, which lasts 3 minutes, the hot gas and water inlet solenoids 30, 42 are energized. It is at the end of this time that an operator may add a cleaning and/or sterilizing solution to the water reservoir. During the next portion of the wash cycle, which lasts for 10 minutes, the water pump and condenser fan motors 44, 70 are energized, and the hot gas and water inlet solenoids are not. Thereafter the system cycles through eight repetitions of a fill and rinse cycle. In each fill cycle the hot gas and water inlet solenoids are energized for 3 minutes. These valves are then closed. The fill cycle is followed by a rinse cycle of 45 seconds in which the water pump and condenser fan motors are energized. During the initial fill part of the wash cycle or a subsequent event, if the toggle switch is turned to the "off" position, the "wash" cycle will abort and the machine will remain off. If the toggle switch is turned to the "on" position during the initial fill part of the wash cycle, or subsequent event, the "wash" cycle will abort and the machine will start in an ice making cycle. At the end of the normal "wash" cycle, the machine will turn off until the toggle switch is flipped to the "on" position. Alternatively the machine could be programmed to go into an ice making mode at the end of the "wash" mode. However, it is preferred to require a manual flip of the toggle switch 87 so that the operator can inspect the machine and clean residual wash and rinse solution from the reservoir 46.

If power is interrupted to the machine, the microprocessor 64 will, when power is restored, start over in a "on" cycle or a "wash" cycle, depending on the toggle switch position.

To further reduce cost, it may be possible to use one relay to control all four of the water pump 44, condenser fan 70, water inlet solenoid 42 and hot gas valve 30. The relay could have two positions. In one position the water inlet solenoid and hot gas valve 30 could be energized, and in the other position the fan 70 and water pump could be energized.

The preferred ice making machine 10 will have the capacity to make about 46 pounds of ice per day and store about 18 pounds of ice in the bin 36. The preferred ice making machine will use R-134A refrigerant, and have a stainless steel cabinet 14.

The preferred controller of the present invention provides a very good control system with very few components, and hence a low cost. This is particularly advantageous for small ice making machines. The control system works well over a wide range of operating conditions, including partially blocked air flow, dirty condenser and varying ambient temperatures. It will be appreciated that the preferred embodiments described above are subject to modification without departing from the invention. For example, other defrost systems rather than a hot gas bypass valve could be initiated by a microprocessor. Therefore it should be understood that the invention is to be defined by the following claims rather than the preferred embodiments described above.

We claim:

1. A method of initiating a harvest cycle in an ice making machine having a compressor, a condenser, an expansion device, an evaporator and refrigerant lines therebetween, the method comprising the steps of:

a) initiating a freeze cycle during which refrigerant from the compressor flows to the condenser, through the expansion device and to the evaporator;

b) measuring the temperature of the refrigerant at a point between the condenser and the expansion device at a predetermined time period after initiation of the freeze cycle;

c) using the temperature measured at said predetermined time period to determine the desired duration of the freeze cycle; and d) ending the freeze cycle and initiating the harvest cycle at the end of the desired duration of the freeze cycle.

2. The method of claim 1 wherein the temperature of the refrigerant between the condenser and the expansion device is measured by a thermistor, which has a voltage drop across the thermistor proportional to the measured temperature.

3. The method of claim 2 wherein the voltage drop across the thermistor is compared to recorded data comparing voltage drops and desired freeze cycle durations to determine the desired freeze cycle duration for the freeze cycle then underway.

4. The method of claim 1 wherein the predetermined time period after initiation of the freeze cycle at which the temperature of the refrigerant line is measured is at a time during which the refrigerant flow is stable.

5. The method of claim 1 wherein a microprocessor is used to end the freeze cycle and initiate the harvest cycle.

6. The method of claim 5 wherein the microprocessor includes recorded data comparing results of past temperature measurements and desired freeze cycle durations that is then used in determining the desired duration of the freeze cycle.

7. The method of claim 1 wherein the temperature of the refrigerant is measured by a sensor sensing the temperature of the refrigerant line between the condenser and the expansion device.

8. The method of claim 7 wherein an electrical output is generated by the sensor proportional to the temperature of the refrigerant line.

9. The method of claim 8 wherein the electrical output is used as an input to a microprocessor, and the microprocessor determines the desired duration of the freeze cycle from the electrical output of the sensor.

10. The method of claim 9 wherein the sensor is a thermistor and the electrical output is a voltage drop across the thermistor.

11. The method of claim 1 wherein the freeze cycle duration includes an additional predetermined increment of time if the freeze cycle was initiated at a time when the compressor was not running.

12. The method of claim 1 wherein said measured temperature at said predetermined time period is the sole measured temperature used to determine the duration of the freeze cycle.

13. A method of controlling a harvest cycle duration of an ice making machine comprising the steps of:

a) initiating a freeze cycle during which refrigerant is compressed by a compressor and discharged to a condenser, from which the refrigerant flows in a refrigerant line to an expansion device, through an evaporator and back to the compressor;

b) measuring the temperature of the refrigerant leaving the condenser at a predetermined time before termination of the freeze cycle;

c) using the temperature measured in step b) to determine the desired duration of the harvest cycle; and d) ending the harvest cycle after the length of time determined in step c).

14. The method of claim 13 further comprising the step of measuring the temperature of the refrigerant leaving the condenser at a predetermined time after initiation of the freeze cycle and using said temperature to determine the desired duration of the freeze cycle.

15. The method of claim 13 wherein the measured temperature in step c) is an average of a series of temperature measurements taken over a short period of time.

16. The method of claim 15 wherein the series of temperature measurements are made by determining the resistance of a thermistor in thermal contact with the refrigerant line downstream of the condenser.

17. The method of claim 13 wherein the temperature measured in step b) is the sole measured temperature used to determine the desired duration of the freeze cycle.

18. An ice making machine comprising:

a) a refrigeration system comprising a compressor, a condenser having an inlet and an outlet, an expansion device, an evaporator and interconnecting refrigerant lines;

b) a water system comprising a fresh water inlet, a water circulation mechanism, an ice-forming device in thermal contact with the evaporator, and interconnecting water lines; and c) a control system comprising a temperature sensing device in thermal contact with the refrigeration system between the outlet of the condenser and the expansion device, and a microprocessor programmed to use input from the temperature sensing device at one or both of i) a predetermined time after initiation of a freeze cycle to determine a desired duration of the freeze cycle, and ii) a predetermined time prior to the end of the freeze cycle to determine the desired duration of the harvest cycle;

to thereafter control the refrigeration and water systems to operate in accordance with the desired duration or durations.

19. The ice making machine of claim 18 wherein the temperature sensing device is a thermistor.

20. The ice making machine of claim 19 wherein the microprocessor uses a voltage drop across the thermistor to determine the desired duration of the freeze cycle.

21. The ice making machine of claim 18 wherein the refrigeration system further comprises a hot gas bypass valve and the microprocessor controls the hot gas bypass valve to thereby initiate freeze and harvest cycles.

22. The ice making machine of claim 21 wherein the water system further comprises a reservoir and the water inlet comprises a solenoid valve controlled by the microprocessor.

23. The ice making machine of claim 22 wherein the control system includes one relay which operates both the hot gas bypass valve to send refrigerant to the evaporator and the water inlet solenoid valve to allow fresh water to enter the system simultaneously.

24. The ice making machine of claim 18 further comprising a fan to move air across the condenser and wherein the control system includes one relay which both energizes the fan and the water circulation mechanism simultaneously.

25. The ice making machine of claim 20 wherein the ice-forming device comprises a pan stamped out of a piece of metal and the stamped pan includes a base plate and monolithic side walls used to shape cubes of ice formed in the ice forming device, the corners of the pan where the side walls intersect being water-impervious as a result of the pan being stamped.

26. The ice making machine of claim 18 wherein the microprocessor is programmed to operate the water system and refrigeration system in a wash cycle in which fresh water is repeatedly introduced into the ice making machine and circulated by the water circulating mechanism while the compressor is off.

27. The ice making machine of claim 19 wherein the thermistor is encapsulated in aluminum.

28. The ice making machine of claim 18 wherein the control system microprocessor is programmed to use said input from said temperature sensing device as the sole temperature used to determine the desired duration of the freeze cycle.

* * * * *

UNITED STATES PATENT AND TRADEMARK OFFICE

CERTIFICATE OF CORRECTION

PATENT NO. : 5,878,583
DATED : March 9, 1999
INVENTOR(S) : Charles E. Schlosser et al.

It is certified that error appears in the above-identified patent and that said Letters Patent is hereby corrected as shown below:

Claim 25,
Line 1, delete "20" and substitute -- 18 -- in its place.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*